US006568210B2

(12) United States Patent
Pompl

(10) Patent No.: US 6,568,210 B2
(45) Date of Patent: May 27, 2003

(54) METHOD AND APPARATUS FOR OBTAINING A GASEOUS PRODUCT BY CRYOGENIC AIR SEPARATION

(75) Inventor: Gerhard Pompl, Beilngries (DE)

(73) Assignee: Linde Aktiengesellschaft, Wiesbaden (DE)

( * ) Notice: Subject to any disclaimer, the term of this patent is extended or adjusted under 35 U.S.C. 154(b) by 0 days.

(21) Appl. No.: 09/950,798

(22) Filed: Sep. 13, 2001

(65) Prior Publication Data

US 2002/0029587 A1 Mar. 14, 2002

(30) Foreign Application Priority Data

Sep. 13, 2000 (DE) ..... 100 45 121

(51) Int. Cl.[7] ..... F25J 3/00
(52) U.S. Cl. ..... 62/646; 62/654
(58) Field of Search ..... 62/654, 646

(56) References Cited

U.S. PATENT DOCUMENTS 4,702,757 A 10/1987 Kleinberg
4,704,147 A 11/1987 Kleinberg
4,817,394 A 4/1989 Erickson
5,114,452 A * 5/1992 Dray ..... 62/646
5,237,822 A * 8/1993 Rathbone ..... 62/646
5,475,980 A * 12/1995 Grenier et al. ..... 62/646
5,765,396 A 6/1998 Bonaquist
5,802,873 A 9/1998 Howard
5,901,577 A 5/1999 Pelle et al.

* cited by examiner

*Primary Examiner*—Ronald Capossela
(74) *Attorney, Agent, or Firm*—Crowell & Moring LLP

(57) ABSTRACT

A method to obtain a gaseous product by the low temperature fractionation of air includes supplying a first, purified and cooled stream of air to a high-pressure column. At least one liquid stream from the high-pressure column is passed into a low-pressure column. A product stream in the liquid state is drawn off from the low-pressure column and is brought to an elevated pressure. The product stream is then evaporated in an indirect heat exchange with a second purified stream of air. The second stream of air, which is condensed at least partly during the indirect heat exchange, is expanded at least partly in a work-producing manner. The second stream of air subsequently is passed into the low-pressure column. The pressure of the second stream of air at the outlet of the work-expansion is lower than the operating pressure in the sump of the high-pressure column. The work-expansion of the second stream of air is carried out in a single step.

11 Claims, 1 Drawing Sheet

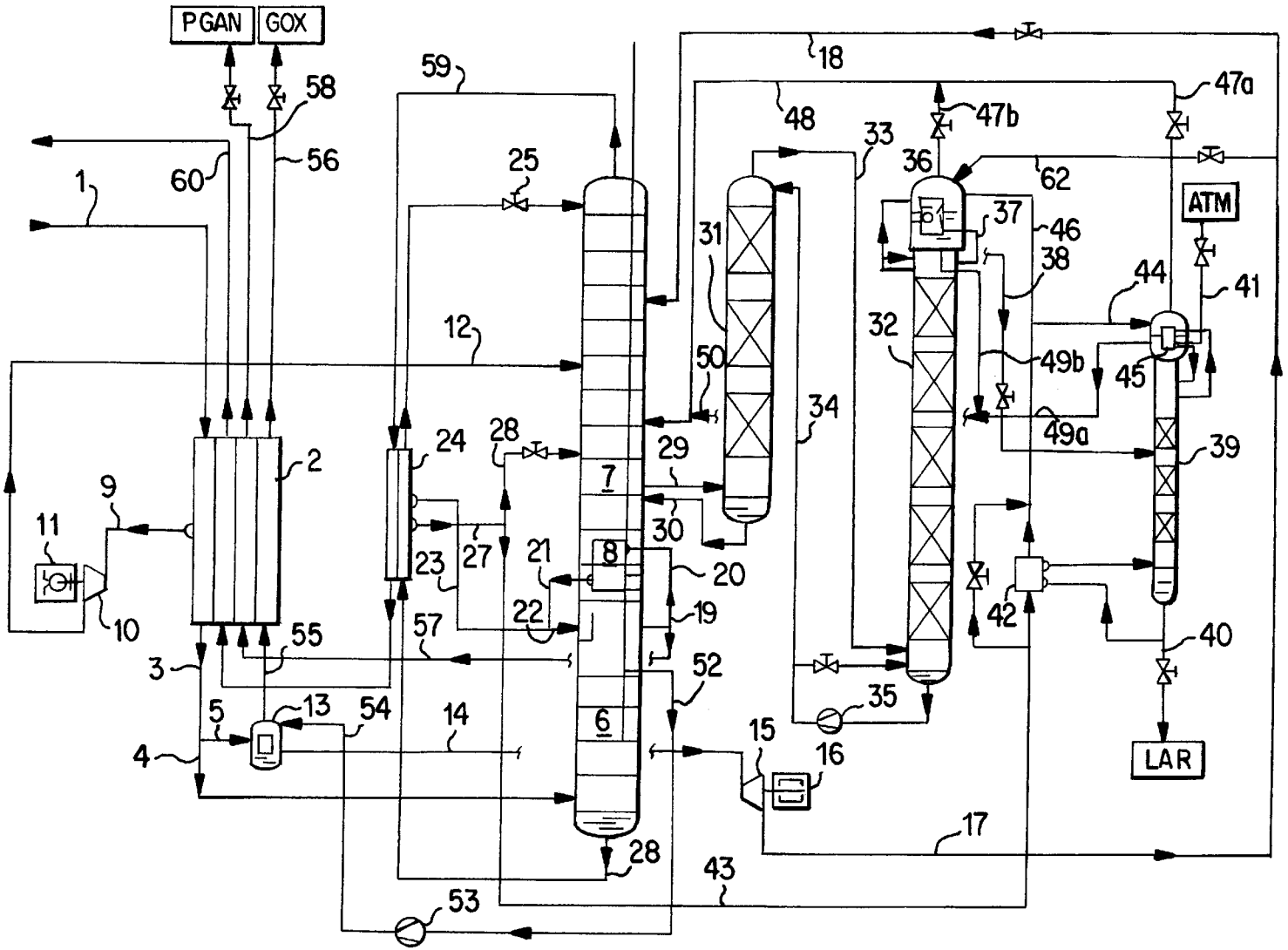
ATM
LAR
PGAN
GOX

METHOD AND APPARATUS FOR OBTAINING A GASEOUS PRODUCT BY CRYOGENIC AIR SEPARATION

BACKGROUND AND SUMMARY OF INVENTION

This application claims the priority of German application No. 100 45 121.7, filed Sep. 13, 2000, the disclosure of which is expressly incorporated by reference herein.

The present invention relates to a method for obtaining gaseous products by the low-temperature fractionation of air. The method includes (1) supplying a first, purified, and cooled stream of air to the high-pressure column; (2) passing at least one liquid stream from the high-pressure column into the low-pressure column; (3) drawing off a product stream in the liquid state from the low-pressure column and, in the liquid state, bringing the product stream to an elevated pressure; (4) evaporating the product stream, under the elevated pressure, in an indirect heat exchange with a second purified stream of air, which is condensed at least partly during the indirect heat exchange; and (5) work-expanding at least part of the second stream of air and subsequently passing the second stream of air into the low-pressure column.

The product stream, which is evaporated by a portion of the air (the second air stream), preferably is an oxygen product from the lower region of the low-pressure column of any purity (for example, 90 to 99.8% and preferably 98 to 99.9%). Preferred areas of application of the present invention are methods in which the second air stream, which is used to evaporate the product stream, has a pressure that is only slightly if at all higher than the operating pressure of the high pressure column (for example, up to twice the pressure of the high pressure column). In this case, all pressure are clearly in the non-critical range; the concepts of "evaporating" and "condensing" are to be understood in this connection as a phase transition. If oxygen is evaporated under such a relatively low pressure, this step of the process is usually not carried out in a main heat exchanger, which is used to cool the air used from ambient temperature to the rectifying temperature. Instead, this step of the process is carried out in a separate secondary condenser. A liquid cycle with rinsing can be set up there, which prevents operating and safety problems resulting from the deposition of components of low volatility.

In addition, the present invention can, in principle, also be used at higher product pressures, which may even be above the critical pressure. In this connection, the concepts of "evaporating" and "condensing" also include "pseudo-evaporating" and "pseudo-condensing". Such a method is known from the EP 869322 A1 (FIG. 3). The pressure, to which liquid or supercritical air is subjected, is relieved in two steps and performs work. Initially, it is relieved in a first step to about the pressure of the high-pressure column and subsequently partially further in a second step to the pressure of the low-pressure column.

It is an aspect of the present invention to provide a method of the type given above, and a corresponding apparatus, which are particularly economically advantageous.

This aspect is accomplished due to the work-expanding of at least part of the second air stream being carried out in a single step. As a result, the pressure difference between the condensation pressure of the second air stream and the pressure of the low-pressure column is utilized particularly efficiently with simple equipment.

The work expansion is carried out in a turbine, which is coupled to a braking device. The braking device may be, for example, a generator or an oil brake.

According to an embodiment of the present invention, it is advantageous if a third air stream is cooled to an intermediate temperature between ambient temperature and the rectifying temperature. This stream of air is expanded while producing work, and the stream of air is supplied to the low-pressure column. Therefore, in addition to the condensed, second stream of air, a further gaseous stream of air is introduced directly into the low-pressure column.

With the help of the two work-performing expansion steps carried out (second and third streams of air), the "natural" pressure drop between the high-pressure column and the low-pressure column is utilized optimally. In many cases, it is possible to recover the whole of the abstracted heat, required for the method, without consuming external energy for compressing air to a pressure clearly above the operating pressure of the high-pressure column. The work expansion machine for the third stream of air is also coupled with a braking device, preferably a generator or a secondary compressor. The secondary compressor can be used, for example, for the secondary compression of the second stream of air, which is used to evaporate the product stream. This secondary compression can take place in the hot or in the cold.

The work-performing expanded second stream of air can be introduced completely or partly directly into the low-pressure column. In many methods, the nitrogen-oxygen fractionation in the high-pressure column and the low-pressure column is followed by the recovery of argon. For this purpose, an argon-containing fraction from the low-pressure column is supplied to a crude argon rectification. In this case, it is advantageous to pass the work-performing expanded second stream of air, before it is introduced into the low-pressure column, into the evaporation space of the condenser-evaporator, which is used for producing liquid reflux for the crude argon rectification and can be constructed, for example, as a head condenser.

The present invention is particularly advantageous at moderate product pressures in the product stream, which is to be evaporated. In such cases, the pressure of the second air stream during the indirect heat exchange with the evaporating product stream is, for example, not greater than 1.5 times the operating pressure in the sump of the high-pressure column. In this connection, it is advantageous if the indirect heat exchange for evaporating the product stream in the liquid state is carried out in a secondary condenser, which is separate from a main heat exchanger, in which the first stream of air is cooled. After it is evaporated in the secondary condenser, the product stream can be introduced into the main heat exchanger and heated there.

Preferably, the first stream of air and the second stream of air and, optionally, the third stream of air are compressed jointly to approximately the operating pressure of the high-pressure column. As a result, the cost of the equipment for compressing the air remains relatively low. If necessary, the second stream of air can be compressed further, warm or cold, downstream from this joint compression.

Other objects, advantages and novel features of the present invention will become apparent from the following detailed description of the invention when considered in conjunction with the accompanying drawings.

BRIEF DESCRIPTION OF THE DRAWING

The sole FIGURE shows an embodiment of an apparatus according to the present invention.

DETAILED DESCRIPTION OF THE DRAWING

Pre-cooled and purified air 1 flows to a main heat exchanger 2, which is constructed as a single block in the example. In practice, there may be two or more heat exchangers, which are connected serially or in parallel. A part 3 of the air is supplied to the cold end of the main heat exchanger 2 and subsequently divided into a first stream 4 of air and a second stream 5 of air. The first stream 4 of air is blown in the gaseous state into the lower region of a high-pressure column 6. The high-pressure column 6 is part of a rectifying system which, in addition, has a low-pressure column 7. The two columns 6, 7 are connected in a heat-exchanging manner over a main condenser 8. The operating pressure at the sump of the high-pressure column 6 is, for example, 5 to 7 bar and preferably 5.5 to 6 bar. The operating pressure at the sump of the low-pressure column 7 is, for example, 1.3 to 1.7 bar and preferably 1.3 to 1.4 bar. The air pressure in pipeline 1 is about equal to the pressure in the high-pressure column plus line losses, Preferably, the whole air is compressed jointly in a single air compressor (not shown).

At an intermediate temperature of the heat exchanger 2, a third stream of air 9 is branched off and is expanded in a work-performing manner in an air-injection turbine 10 to about the operating pressure of the low-pressure column and blown at an intermediate position (12) into the low-pressure column. In the example, the air-injection turbine 10 is braked with a generator 11.

The second stream 5 of air is condensed completely in a secondary condenser 13. The whole of the condensed air is supplied to a liquid turbine 15, which has a single work-expanding step. Due to the expansion, the pressure on the condensed air 14 is changed from about the pressure of the high-pressure column to approximately the pressure of the low-pressure column. The liquid turbine 15 is braked by generator 16.

The work-expanded liquid air 17 is supplied completely or to the extent of a first part 18 into the low-pressure column at an intermediate position, which lies above the place at which the gaseous air 12 from the air-injection turbine 10 is introduced. Alternatively or, in addition, the work-expanded liquid air 17 can be passed completely or, to the extent of a second part, over an evaporating space of a condenser-evaporator 61 into the low-pressure column (pipelines 62; 47*b*–48; 49*b*–50). The condenser-evaporator 61 is described in greater detail below.

Gaseous nitrogen 19 from the head of the high-pressure column is introduced completely or partly over pipeline 20 into the main condenser 8 and condensed there by indirect heat exchange with evaporating oxygen from the sump of the low-pressure column 7. A first portion 22 of the condensate 21 is added to the high-pressure column as reflux; a second portion 23, after being supercooled in a countercurrent supercooler 24 and throttled 25, is supplied as reflux for the low-pressure column 7. Crude liquid oxygen 26 from the sump of the high-pressure column is also introduced into the counter-current supercooler 24. A first portion 28 of the supercooled crude oxygen is throttled directly into the low-pressure column between the injection air 12 and the argon transition 29/30, which is described further below.

Oxygen 52 is drawn off in the liquid state as the product stream from the sump of the low-pressure column 7 and brought in a pump 53 to a product pressure, which is, for example, 1.3 times the operating pressure at the sump of the low-pressure column. The liquid oxygen 54, which is brought to the product pressure, is evaporated completely in the secondary condenser 13, with the exception et a ringing, which is not shown, and supplied over pipeline 55 to the main heat exchanger 52. The oxygen 56, heated approximately to ambient temperature, is obtained as gaseous pressure product (GOX).

In addition, gaseous nitrogen under pressure 58 (PGAN) can be produced by the method, in that a portion 57 of the gaseous nitrogen 19 is drawn off directly from the head of the high-pressure column 6 and heated in the main heat exchanger 2. Pressureless nitrogen 59, 60 from the head of the low-pressure column 7, can also be obtained as a product and/or used as regenerating gas in an apparatus, which is not shown and is used to purify the air used.

In addition to the oxygen-nitrogen fractionation, the method of the example includes a step for the recovery of argon. For this purpose, the low-pressure column 7 communicates over a further intermediate position (argon transition) over pipelines 29 and 30 with a crude argon rectification, which is carried out, in the example, in two crude argon columns 31 and 32, which are connected serially (compare European patent EP 628777). The gas pipeline 33 and the liquid pipeline 34 with the pump 35 establish the connection between the two columns 31, 32. Reflux for the rectification of the crude argon is produced in a condenser-evaporator 61, which is constructed as a head condenser of the column 32. Head gas 36 of the crude argon rectification is liquefied here and a first part 37 of it is added to the head of the second crude argon column 32. The remaining gaseous crude argon 38 flows to a pure argon column 39 and is freed there from more readily volatile impurities, which are drawn off over the head (pipeline 41) and are discarded (ATM). Over pipeline 40, the liquid pure argon product (LAR) is discharged from the sump of the pure argon column 39.

The sump heater 42 of the pure argon column 39 is operated with a portion 43 of the supercooled, liquid crude oxygen 27 from the high-pressure column 6 (see European patent EP 669509). A portion 44 of the crude oxygen 43, which is supercooled further, abstracts the heat from the head condenser 45 of the pure argon column 39, the remainder 46 flows into the evaporating space of the condenser-evaporator 61 of the crude argon rectification 31, 32 and, if necessary, is supplemented by a portion 62 of the liquid air 17, which was expanded so as to perform work. The vapor 47*a*, 47*b*, produced in the evaporating spaces of the two head condensers, is supplied over pipeline 48 to the low-pressure column 7, as is the rinsing liquid 49*a*, 49*b* over pipeline 50.

To increase the product pressure of the gaseous oxygen pressure product 55, 56 to, for example, 1.4 to 2 times the operating pressure of the low-pressure column, the method of the example may have a cold or warm secondary compressor for the second stream of air (not shown). In the case of a cold secondary compression, a cold compressor is installed in pipeline 5. In the case of a further warm compression, the second stream of air is separated from the total air 1 already upstream from the main heat exchanger 2, supplied to a secondary compressor with aftercooling, cooled separately in its own passage of the heat exchanger 2 and, finally, analogously to pipeline 5, supplied to the liquefaction space of the secondary condenser 13.

A collector, as phase separating device (not shown), may be installed in the pipeline 14 between the secondary condenser 13 and the liquid turbine 15. That portion of the second stream of air, which possibly has remained gaseous during the condensation in the secondary condenser, is separated here and passed over a throttling valve into the high-pressure column 6 and/or into the low-pressure column 7. Only the liquid portion of the 'optionally partially' condensed second stream of air 14 is supplied to the liquid turbine 15. The collector can also be used to control the liquid turbine 15, in that the liquid level controller at the collector acts on the rpm of the liquid turbine. For the gas drawn off from the collector, the pressure in the collector can be controlled by the throttling valve.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for obtaining a gaseous product by low temperature fractionation of air in a rectifying system having a high-pressure column and a low-pressure column, said method comprising:

a. supplying a first, purified, and cooled stream of air to the high-pressure column;

b. passing at least one liquid stream from the high-pressure column into the low-pressure column;

c. drawing off a product stream in the liquid state from the low-pressure column and, in the liquid state, bringing the product stream to an elevated pressure;

d. evaporating the product stream having an elevated pressure in an indirect heat exchange with a second purified stream of air, thereby at least partly condensing the second purified stream of air;

e. work-expanding at least part of the at least partially condensed second stream of air and subsequently passing the second stream of air into the low-pressure column; and f. the pressure of the second stream of air at the outlet of the work-expanding it lower than the operating pressure in the sump of the high-pressure column, wherein the work-expanding of the at least partially condensed second stream of air is carried out in a single step.

2. A method according to claim 1, further comprising:

cooling a third stream of air to an intermediate temperature between ambient temperature and a rectifying temperature;

expanding the third stream of air in a work-producing manner; and supplying the third stream of air to the low-pressure column.

3. A method according to claim 1, further comprising supplying an argon-containing fraction from the low-pressure column to a crude argon rectification.

4. A method according to claim 3, further comprising:

condensing an argon-rich gas from the crude argon rectification in a condensation space of a condenser-evaporator; and passing at least a portion of the pressure-relieved second stream of air into the evaporation space of the condenser-evaporator before it is passed into the low-pressure column.

5. A method according to claim 1, wherein a pressure of second air stream during the indirect heat exchange is not greater than twice the operating pressure in the sump of the high-pressure column.

6. A method according to claim 1, wherein the indirect heat exchange is carried out in a secondary condenser that is separate from a main heat exchanger in which the first, purified air stream is cooled.

7. A method according to claim 6, further comprising introducing the evaporated liquid product stream from the secondary condenser into the main heat exchanger.

8. A method according to claim 1, further comprising jointly compressing the first and second air streams, and optionally a third air stream, to approximately an operating pressure of the high-pressure column.

9. A device for obtaining a gaseous product by low-temperature fractionation of air, comprising:

a. a rectifying system having a high-pressure column and a low-pressure column;

b. a first air pipeline for passing a first, purified, and cooled stream of air into the high-pressure column;

c. at least one liquid pipeline for passing a liquid stream from the high-pressure column into the low-pressure column;

d. a liquid product line for removing a product stream in the liquid state from the low-pressure column and having means for increasing the pressure of the product stream in the liquid state; and e. means for evaporating the product stream by an indirect heat exchange, which is connected with a second air pipeline; and f. a liquid pipeline leading from the means for evaporating the liquid product stream, through an expansion machine into the low-pressure column, g. wherein the expansion machine is constructed so that its outlet pressure, during the operation of the device, is lower than the operating pressure at the sump of the high-pressure column.

10. A device according to claim 9, wherein the means for evaporating the liquid product stream is a secondary condenser that is separate from a main heat exchanger, through which the first air pipeline leads.

11. A device according to claim 9, wherein the expansion machine is a turbine.

* * * * *